United States Patent [19]

Mai et al.

[11] Patent Number: 4,973,930

[45] Date of Patent: Nov. 27, 1990

[54] TWIN COIL

[75] Inventors: Udo Mai; Uwe Hartmann, both of Untergriesbach, Fed. Rep. of Germany

[73] Assignee: Vogt Electronic Aktiengesellschaft, Erlau bei Passau, Fed. Rep. of Germany

[21] Appl. No.: 379,560

[22] Filed: Jul. 12, 1989

[30] Foreign Application Priority Data

Jul. 20, 1988 [DE] Fed. Rep. of Germany ..... 3824642

[51] Int. Cl.[5] ..... H01F 27/30; H01F 27/34

[52] U.S. Cl. ..... 336/171; 336/180; 336/181; 336/198

[58] Field of Search ..... 336/136, 130, 131, 171, 336/180, 181, 170, 221, 198, 208

[56] References Cited

U.S. PATENT DOCUMENTS

| | | | |
|---|---|---|---|
| 1,775,880 | 9/1930 | Whitlock | 336/171 |
| 2,555,853 | 6/1951 | Irwin | 336/181 X |
| 3,376,533 | 4/1968 | Chass | 336/136 |
| 3,445,928 | 5/1969 | Beynon | 336/181 X |
| 3,458,844 | 7/1969 | Hildebrandt | 336/136 X |
| 4,339,739 | 7/1982 | Dron | 336/136 |
| 4,473,811 | 9/1984 | Schauble | 336/171 |
| 4,680,566 | 7/1987 | Goseberg et al. | 336/181 |

*Primary Examiner*—Thomas J. Kozma
*Attorney, Agent, or Firm*—Fiddler & Levine

[57] ABSTRACT

A coil arrangement comprising two coils on a single coil former, termed a twin coil, is characterized in that the two coils (W1, W2 and, respectively, W3A), with any respective individual magnetic core (10 or, respectively, 9) required, are mounted with a substantial distance from each other on the coil former (1) and in that the respective residual coupling of the coils (W1, W2 and W3A) is eliminated by an oppositely wound or connected compensation winding (W3B). The compensating winding (8) is located in the one winding compartment (3) and has current from the coil in the other winding chamber (4) flowing through it. As a result the twin coil in accordance with the invention leads to some advantages over known twin coils in which the coupling between the two coils is nearly 100%.

3 Claims, 1 Drawing Sheet

TWIN COIL

In viewing and monitoring devices such as more especially television equipment reasons of economy make it desirable to so combine inductances that two coils are on a single coil former. The invention relates to such a coil arrangement (or twin coil) having two coils arranged on a common coil former.

Combined coils of this type have been proposed in the European Patent 0 171 690. Such known coils have a series of disadvantages. They involve a practically 100% coupling of the windings so that matching is impeded. Furthermore the unavoidable inaccuracies in manufacture of such coils involve a large amount of measuring operations and a large reject quota, since repair of faulty coils is practically impossible. A further point is that the windings are heated due to the eddy current losses of the other respective field. Finally, it is necessary to damp the drive circuit by means of the external load resistor.

The object of the invention is to devise an arrangement of the initially noted type which while producing the same effect in the circuit avoids the above noted disadvantages of known coils of this type.

In the twin coil in accordance with the invention the individual coils, which may have their own core if necessary, are arranged with substantial spacing between them on the common coil former so that undesired coupling is minimized. The residual coupling still present may be reduced to a negligible value if desired by the provision of a non-critical opposite winding.

The twin coil in accordance with the invention has more particularly the following advantages over known coil arrangements:

(1) Matching is no longer required, since it is only necessary to compensate for the small amount of residual coupling due to the mechanical structure and this may be done by having a few opposite or oppositely connected turns on the windings of the other coil.

(2) The amount of copper required is smaller.

(3) The winding time is reduced.

(4) The eddy current losses are less since the windings are no longer intersected by the respective other field; as a result a smaller copper cross section becomes possible (5) In the case of a circuit with a drive transformer the latter may contribute to damping the circuit so that the above mentioned load resistor may be dispensed with. The result is thus economic savings. The design in accordance with the invention may however be used in all those cases in which it is possible to wind two coils on a common coil former for economic reasons.

Figure 1:
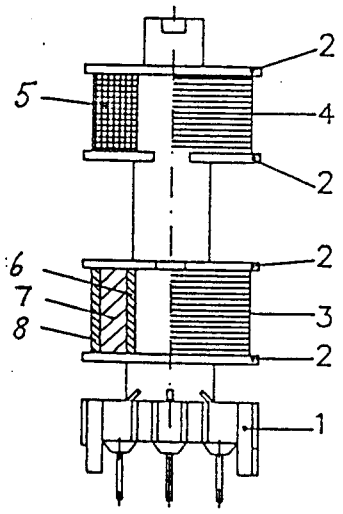
Figure 2:
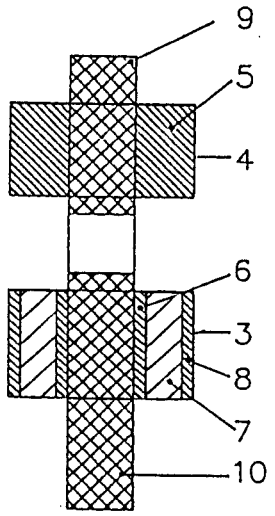

The twin coil in accordance with the invention will be described in more detail with reference to the drawing showing as an example one embodiment thereof. FIGS. 1 and 2 are a diagrammatic FIGS. 1 and 2 are a diagrammatic side view and a partial section of the twin coil.

Figure 3:
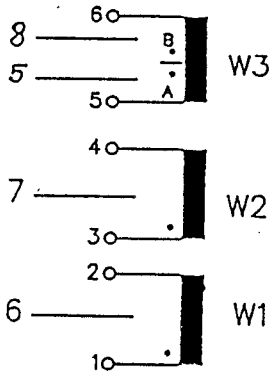

FIG. 3 shows the schematic of the windings of the two coils of the twin coil.

As will be seen in FIG. 1 the twin coil has coil former 1 with a foot and connection pins. The coil former 1 is provided with four flanges 2, which define two winding compartments 3 and 4. In FIG. 2 the relative position of two cores 9 and 10 in the coil former 1 and the placement of the windings as in FIG. 3 in the winding compartments 3 and 4 will be seen. Reference numeral 5 indicates the vertical winding as such denoted W3A in FIG. 3, which is continued as the compensation winding 8 denoted W3B in FIG. 3 and which is composed of a few turns and extends oppositely over the full winding width in the winding compartment 3, as seen in FIG. 2 which compartment also accommodates a secondary drive winding 6 denoted W1 in FIG. 3 and a primary drive winding 7 denoted W2 in FIG. 3. The arrangement of the compensating winding 8 in the compartment 3 leads to the further effect that the end of this winding assumes a position at the foot of the coil former.

Coil arrangements in accordance with the invention may for example be utilized as drive and vertical deflection integration coils or as coupling or bridge coils for the east west diode modulator in viewing devices.

We claim:

1. A twin coil arrangement comprising: an elongate coil former having substantially spaced magnetic coil cores thereon with the spacing between said cores permitting relatively minimal magnetic coupling between any coils wound on said cores; a first coil formed by a first winding on one of said cores; a second coil formed by a second winding on the other of said cores; and a compensating winding surrounding said second winding, said compensating winding being oppositely wound, and electrically coupled to said first winding forming and said first coil, said compensating winding eliminating any residual coupling between said first and second coils.

2. A twin coil arrangement as in claim 1, in which said second winding of said second coil is formed as a primary winding surrounding a secondary winding on said other core.

3. A twin coil as in claim 1, in which flanges are formed on said spaced cores to define winding compartments for the windings forming the coils on said cores.

* * * * *